United States Patent [19]

Andersson

[11] Patent Number: 4,560,322

[45] Date of Patent: Dec. 24, 1985

[54] REGULATOR FOR REGULATING THE OUTPUT PRESSURE OF A MOTOR DRIVEN PUMP

[76] Inventor: Ulf Andersson, Ladugardsvägen 6, 440 06 Gråbo, Sweden

[21] Appl. No.: 573,936

[22] PCT Filed: May 13, 1982

[86] PCT No.: PCT/SE82/00169

§ 371 Date: Jan. 12, 1984

§ 102(e) Date: Jan. 12, 1984

[87] PCT Pub. No.: WO83/04074

PCT Pub. Date: Nov. 24, 1983

[51] Int. Cl.[4] ..... F04B 49/00

[52] U.S. Cl. ..... 417/26; 417/19; 417/34

[58] Field of Search ..... 417/34, 19, 20, 26

[56] References Cited

U.S. PATENT DOCUMENTS 2,704,631 3/1955 Bancel ..... 417/26
2,816,507 12/1957 LeGore ..... 417/34 X
2,989,000 6/1961 Alcaro ..... 417/19
3,796,515 3/1974 Lindgvist et al. ..... 417/34 X
4,140,436 2/1979 Schumacher ..... 417/28 X

*Primary Examiner*—Richard E. Gluck

[57] ABSTRACT

Regulator in a motor driven pump for the regulation of the output pressure according to a predetermined value. An automatically functioning reliable regulation according to a predetermined value in order to impede cavitation and reduce the risk of an interrupted flow of liquid in the pump is provided by means of the invention. This is made possible by means of a double diaphragm (12) via a preferably spring biased transmission means (4, 10) of movement being in connection with a controlling means serving the purpose to control the capacity of the power source of the pump and with a space (27) between the diaphragm elements (12A, 12B) of said double diaphragm (12) being connected with the output pressure (30) from the pump for the actuation of the double diaphragm (12) in order to adjust the controlling means of the capacity in a desired degree, and increased or decreased fluid output from the pump bringing about a displacement of the double diaphragm (12) to its maximum position (FIG. 4) or minimum position (FIG. 5) respectively.

10 Claims, 7 Drawing Figures

REGULATOR FOR REGULATING THE OUTPUT PRESSURE OF A MOTOR DRIVEN PUMP

The present invention relates to a regulator in a motor driven pump for the regulation of the output pressure so as to maintain a predetermined value.

It is a principal object of the present invention to provide a regulator of the kind mentioned above, which automatically and reliably regulates the output pressure according to a previously adjusted value, by way of example in connection with an increase or a reduction respectively of the output flow from the pump, among other things in order to prevent cavitation and to reduce the risk of an interruption of the flow of the liquid in the pump.

It is an additional object of the invention to throttle the liquid supply to the motor of the pump to a minimum automatically, when there is an interruption in the supply.

Regulators of the prior art function either electronically or by means of pistons. Such constructions are complicated and have large dimensions.

The objects of the invention are obtained by means of a regulator according to the present invention, which is substantially characterized by a main valve arrangement, preferably a double diaphragm, which via a preferably spring biased transmission means of movement is connected with a control mechanism serving the purpose of regulating the capacity of the pump. A chamber, which is defined by or bordering upon said main valve arrangement, is connected with the output pressure from the pump in order to actuate said main valve arrangement, so that the adjustment of the control mechanism of the pump capacity to a desired degree can be made. An increased or reduced, respectively, fluid output from the pump causes a displacement of the main valve arrangement towards the maximum and the minimum position respectively of the same.

Figure 1:
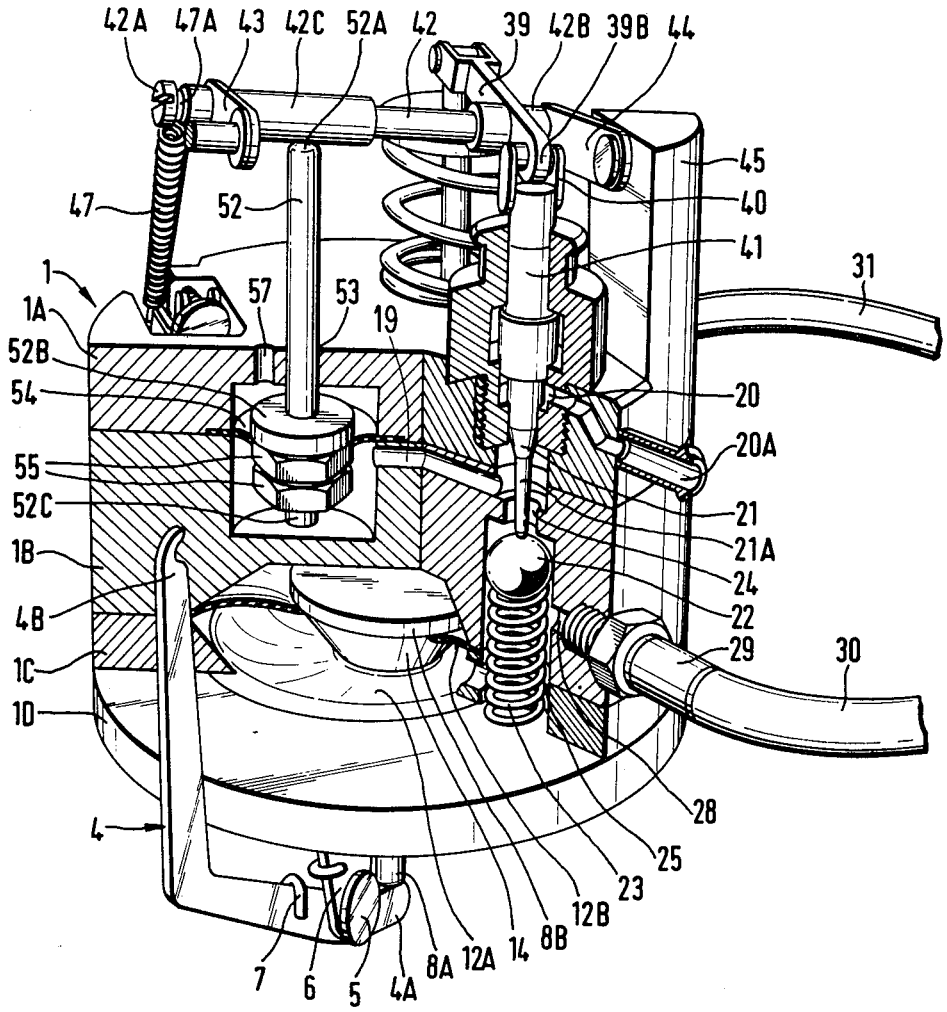
Figure 2:
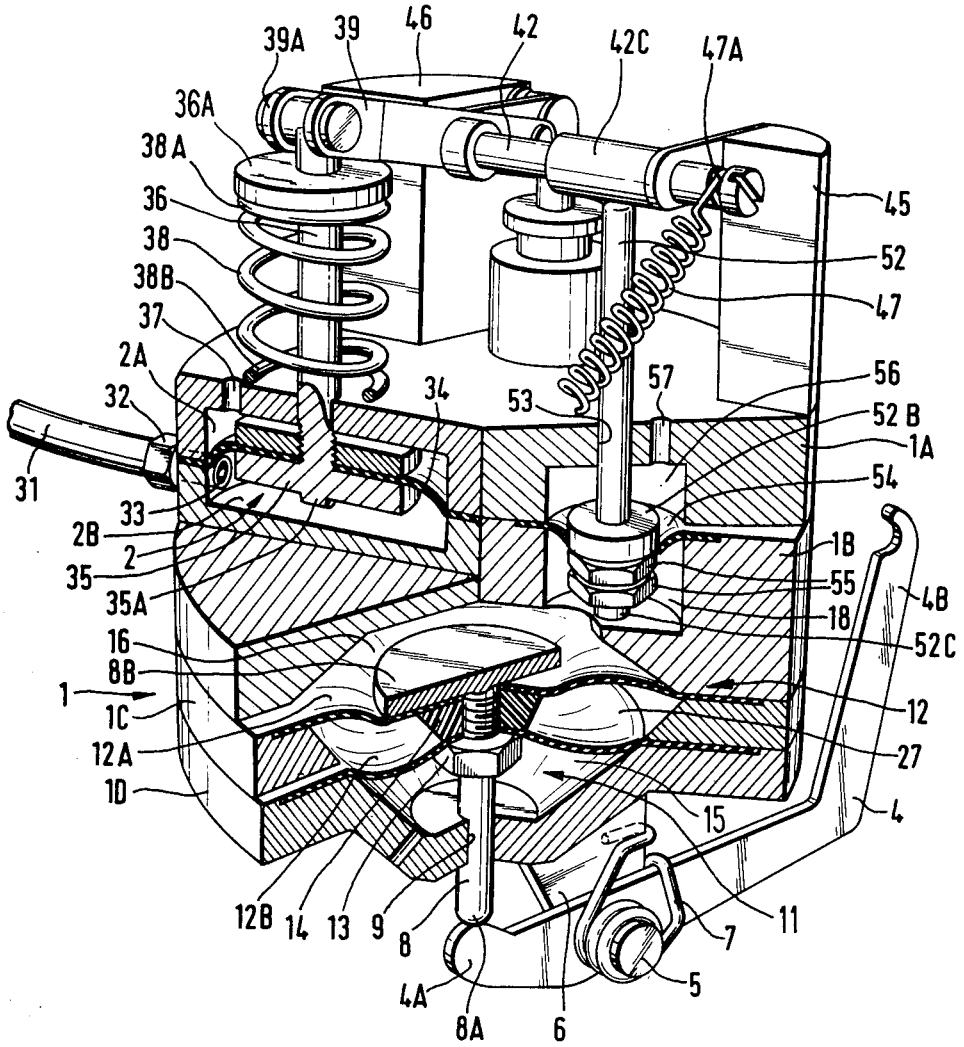
Figure 3:
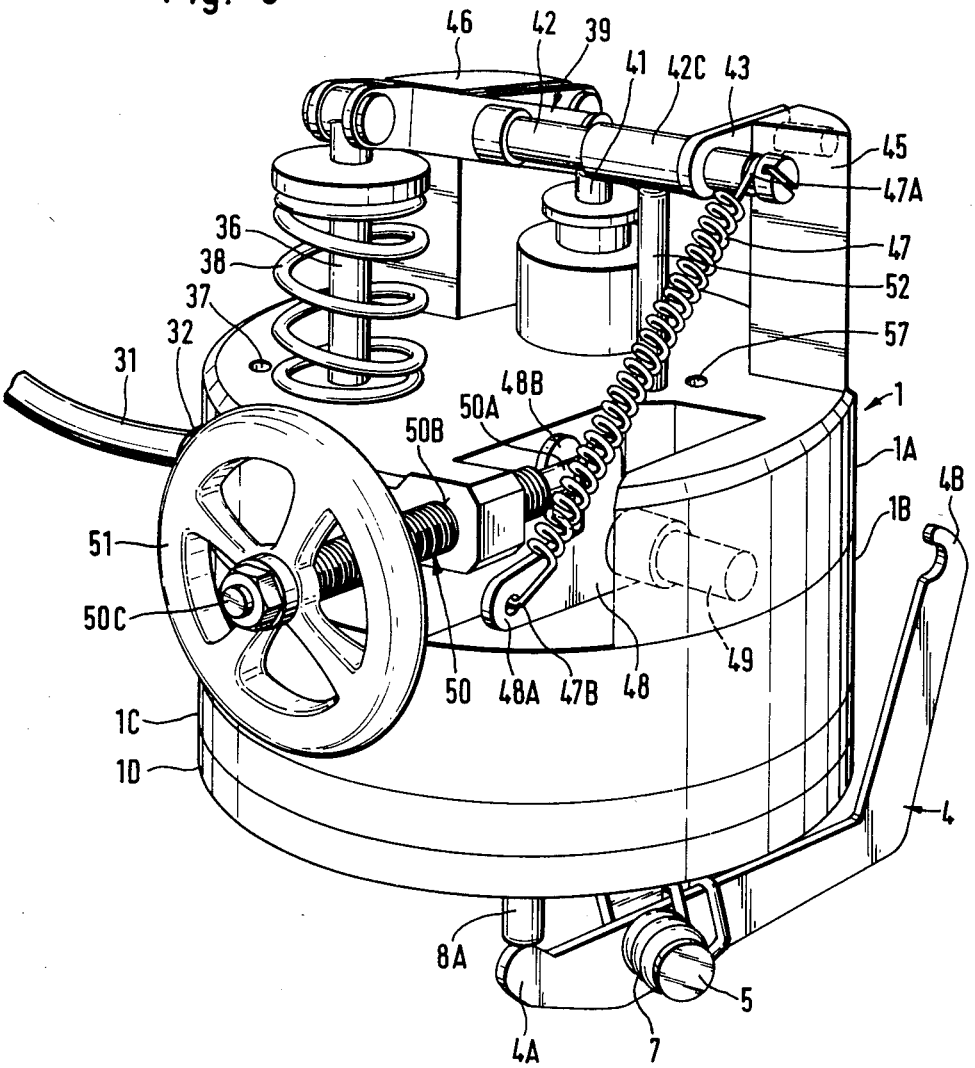
Figure 4:
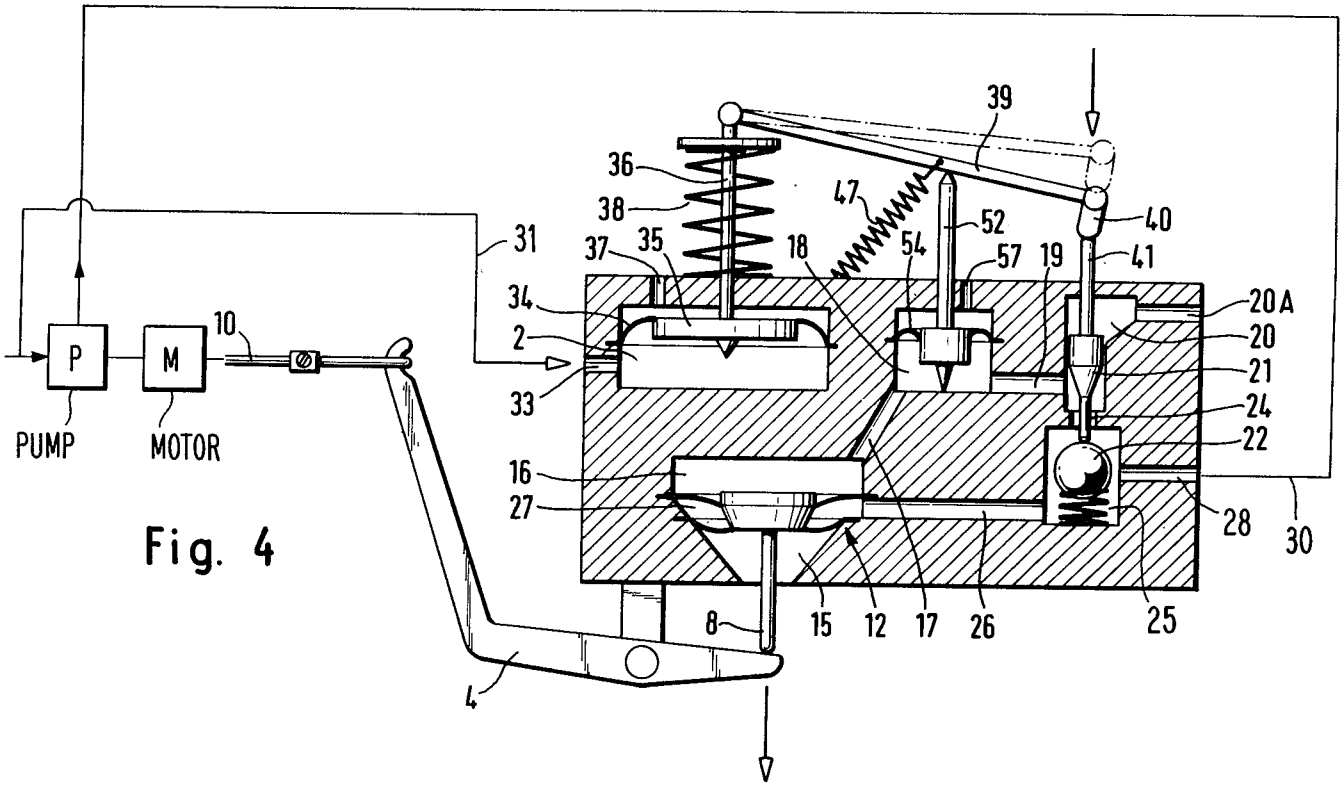
Figure 5:
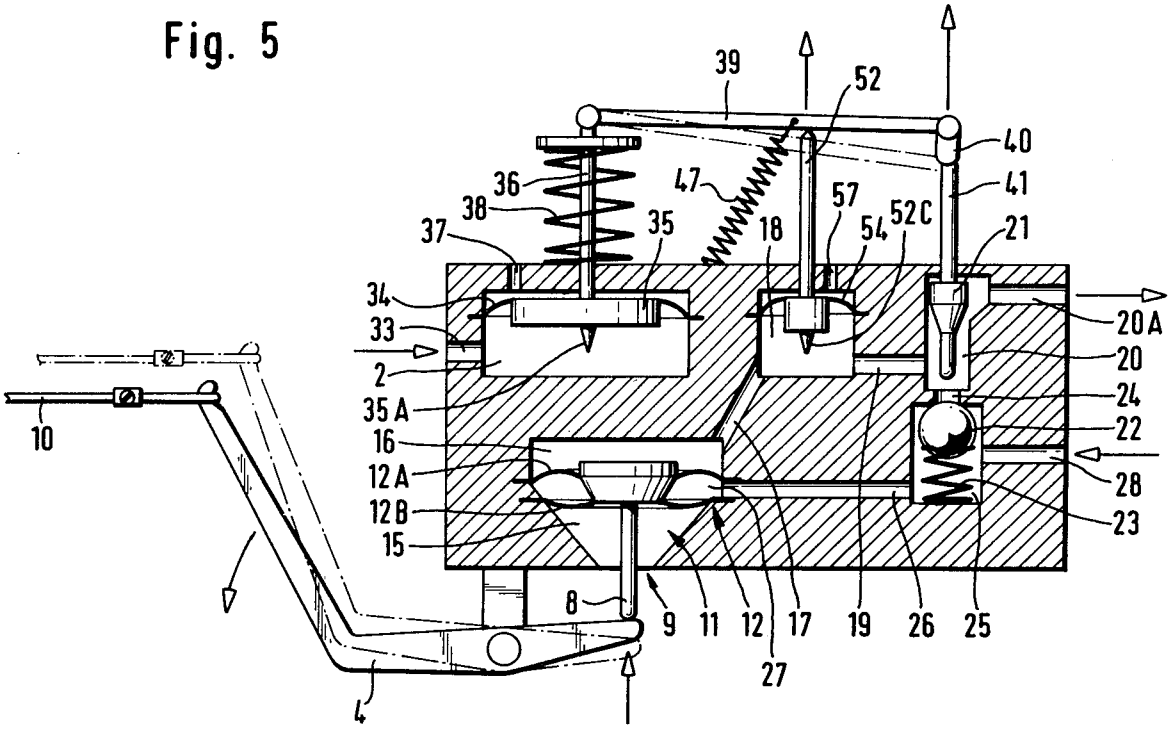
Figure 6:
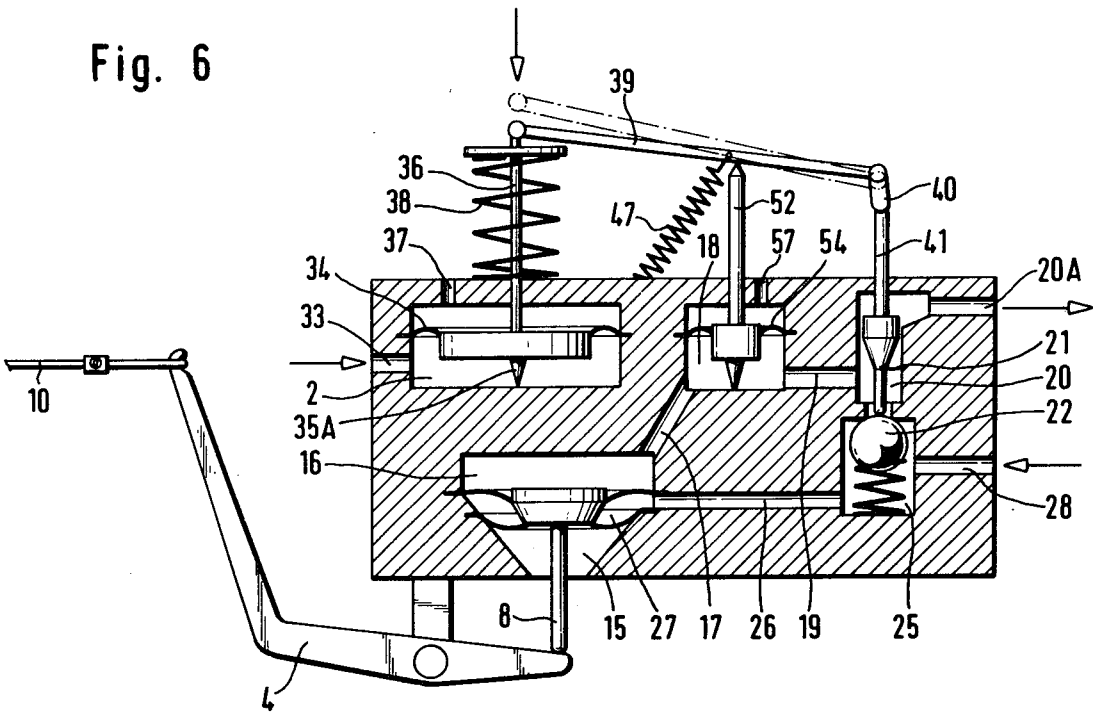
Figure 7:
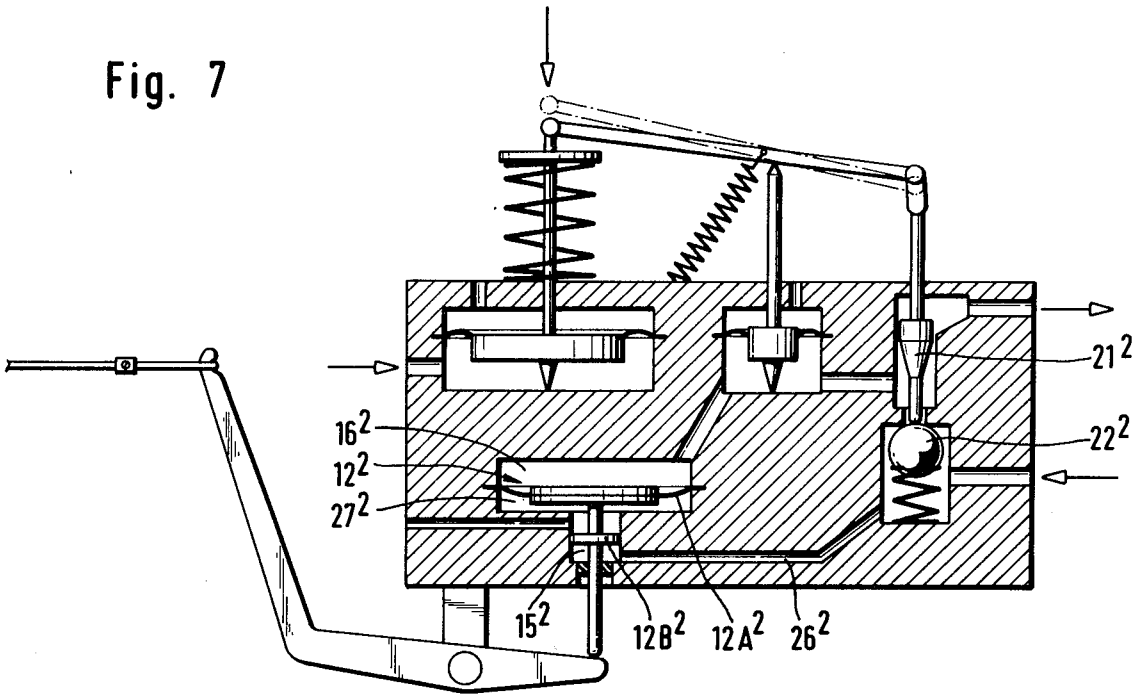

The invention is described in the following, reference being made to the accompanying drawings, in which:

FIG. 1 is a partly sectional perspective view of a regulator designed according to the invention, FIG. 2 shows the regulator in another sectional view, FIG. 3 is a peerspective view of the regulator, FIG. 4 is a schematical view showing the regulator in a first position, FIG. 5 shows the regulator in a second position, FIG. 6 shows the regulator in a third position, and FIG. 7 shows an additional embodiment of a regulator.

The regulator is intended to find an application in pumps working with a liquid.

More specifically (FIG. 8) the regulator R of the invention described in greater detail further below is connected to the suction and pressure sides of a pump P via hoses 31 and 30, respectively. Regulator R controls, via a linkage 4 and wire 10, a motor M which in turn drives pump P. Regulator R has a regulator housing, which in the drawings is indicated with the digit 1. It is formed by a number of housing parts 1A, 1B, 1C and 1D respectively, which are coupled together and have a number of recesses which in unassembled condition of the parts 1A–1D are open and located right in front of each other in order to form a number of chambers and spaces, the location and function of which will be explained further on.

The housing 1 has a preferably angular arm 4, which is pivoted on a shaft 5, which is supported by a fastening means 6 on the housing 1. Said arm 4 by the bias of a spring 7 tends with one angular arm portion 4A to be moved in direction towards the housing 1, while at the same time it is abutting against one end 8A of a pistion rod 8, which through an opening 9 protrudes out of the housing 1.

The other angular arm portion 4B of the pivoting arm 4 is connected with the throttle control of the propulsion means of the pump, i.e. the motor, said connection by way of example comprising a wire 10 (see FIGS. 4 to 6) or other similar transmission means. The spring biased piston rod 8 through the opening 9 penetrates into a space 11, which extends through the three housing parts 1B, 1C and 1D, and in the space between the same clamps two diaphragm elements 12A and 12B respectively, which together form a double diaphragm 12. This double diaphragm 12 is by means of the end portion 8B of the piston rod 8, that penetrates into the housing, and a nut 13 and with an interspaced spacer block 14 connected with the piston rod 8, as is shown in FIG. 2 in the drawing. The element 12A is held nearest to the end 8B of the piston rod 8, which penetrates into the housing 1, and has a considerably greater area than element 12B, the relation preferably being in the order of 4:1 as a condition for the satisfactory function of the regulator.

The space 11, upon which the smaller one 12B of the two elements 12A and 12B respectively of the double diaphragm borders, has a passage to the surrounding ambient air, i.e. this space 11 is under atmospheric pressure. The other space 16, which forms a chamber 16 denominated the "first chamber", is via a duct in communication with an additional chamber 18 denominated the "middle chamber". Said middle chamber 18 is in its turn via an additional duct 19 in communication with a space 20, in which a mushroom valve body 21 or the like can be displaced.

A ball valve body 22 which together with said mushroom valve body 21 forms the other controllable part in a secondary valve arrangement, can by means of a pressure spring 23 be pressed against an opening 24 between said muchroom valve space 20 and a chamber 25, which receives the ball valve body 22, said chamber 25 in one direction via a duct 26 emptying into a space 27 formed between the two elements 12A and 12B respectively of the double diaphragm 12 and in the other direction via an additional duct 28 leading to a hose connection 29. Connected 29 holds the end of the hose 30 departing from the pump, said hose 30 being connected with the pressure side of the pump for sensing the output pressure of the same. An additional hose 31, which is connected with the pump at its suction side, is via a hose connection 32 connected with an additional input passage 33, which empties into the chamber denominated the "second chamber" 2, in which a diaphragm 34 is clamped on a piston 35, the piston rod 36 of which projects out of the housing 1. A boss 35A is provided on the piston 35 and is intended to be able to co-operate with a bottom portion of the chamber 2. The one part of the chamber 2, which is located on the upper side of the diaphragm 34, is via a passage 37 in communication with the surrounding atmosphere. A pressure spring 38 abuts with one end 38A against the upper portion 36A of the piston rod 36, on which a swinging arm 39 is pivoted with one end 39A. The other end 39B of the swinging arm 39 is via an articulation 40 pivoted on a regulating pin 41 connected with the valve body 21 and protruding out of the housing 1.

The swinging arm 39 has a shaft 42 extending across the arm 39 and at each one of its respective two ends supporting an angles arm 43 and 44 respectively, which are rigidly connected with said shaft 42, each one of said angled arms being pivoted on uprights 45 and 46 respectively projecting in upwards direction from the housing 1.

A helecal spring 47 is with one end 47A connected with the shaft 42. The other end 47B of the spring 47 is in turn connected with one arm 48A of an angular part 48 pivoted on a shaft 49 in the housing. The other arm 48B (FIG. 3) of the angular part 48 is pivoted on one end 50A of a shaft 50 provided with threads and screwed into a threaded hole 50B of the housing 1. A wheel 51 is rigidly connected with said shaft 50, which is provided with threads, at the protruding end 50C of the same and forms a throttling means, by means of which the supporting point of the spring 47 can be changed to thereby adjust the spring 47, so that it will have the desired spring force.

The shaft 42 abuts with one portion 42C against the upper end 52A (FIG. 1) of an additional shaft 52, which through an opening 53 penetrates into the housing 1 and enters the chamber 18, which is above denominated the "middle chamber". A diaphragm 54, which by means of a supporting part 52B and nuts 55 is supported on the shaft 52, is connected with said shaft 52, which has a bottom portion forming a boss 52C, which is intended to be able to cooperate with a bottom portion of the chamber 18. The diaphragm 54, which is clamped between the housing parts 1A and 1B, divides the chamber 18 into a bottom chamber 18 and an upper chamber 56, which upper chamber 56 is in communication with the atmosphere via a duct 57.

The function of the regulator described above will now be explained more in detail starting with the case arising in connection with an increased fluid output from the pump, reference being made to FIG. 4 in the drawings.

The output pressure from the pump is then somewhat reduced, which fall of pressure is transmitted to the space 27 between the two diaphragm elements 12A and 12B respectively of the double diaphragm 12, this taking place via the hose 30, the chamber 25 and the duct 26. The equilibrium, which has previously prevailed in said space 27, and which has previously been adjusted by means of the throttling means, wheel 51, is then interrupted. The diaphragm 12 on account of the difference in size of the areas of the elements of the diaphragm thereby tends to be pressed in the direction towards the maximum position. In the drawing this is the direction, in which the piston rod 8 projects in downwards direction, so that the arm 4 gradually actuates the wire 10 causing the same to increase the supply of liquid, such as gasoline, to the pump motor. The pressure in the first chamber 16 is reduced, the diaphragm 54, which is balanced against the the spring 47, sinking in downwards direction towards the boss 52C. The arm 39, which constitutes the connection between the diaphragm 54 and the valve body 21 then will actuate the valve body 21, so that it will press down the ball valve body 22 by means of the downwards projecting portion 21A. The quantity of liquid, which is required in order to cause the double diaphragm 12 to be pressed down into the position, that corresponds to the preadjusted pressure, then via the passage 24 flows into the chambers 18 and 16 respectively. However, it should be noted that upon the diaphragm 12 being pressed down, the gasoline supply to the motor is increased, which causes the pressure from the pump to increase. The setting of the spring 47 warrants a certain pressure in the first chamber 16, which in its turn warrants a pressure, that is proportionally greater with respect to the areas of the elements 12A and 12B respectively of the diaphragm, i.e. the output pressure, which is transmitted from the pump. When a state of equilibrium has been obtained the diaphragm 54 is pressed to a middle position in which position the protruding part 21A of the valve body 21 abuts exactly closely against the ball valve body 22. In this position an exceedingly small quantity of liquid flows through the regulator and out via the discharge 20A to the surrounding air. The fact that liquid flows past the valve body 21 in this position is a necessary feature for the satisfactory function of the diaphragm 34 in the chamber 2, as will be explained further on. The described sequence has brought about that the pump now pumps a greater quantity of liquid at the same pressure as before.

When on the other hand the output of liquid from the pump decreases, the regulation takes place in the following manner, reference being made to FIG. 5. The output pressure from the pump tends to increase, which causes the diaphragm 12 to be pressed in upwards direction, so that the arm 4 tends to actuate the wire 10 to reduce the gasoline supply. The pressure in the first chamber 16 increases, the diaphragm 54 as well as the valve body 21 then being pressed upwards, the latter reaching its maximum position letting out an increased quantity of liquid through the discharge opening 20A. The diaphragm 12 is displaced in upwards direction to its minimum position and this, as has been said previously, brings in its train that the gasoline supply is reduced. The diaphragm 12 then occupies a position, which corresponds to the reduced output of liquid from the pump, i.e. an equilibrium has been obtained. Also the valve body 21 occupies a position of equilibrium, while the ball valve body 22 substantially completely blocks the passage 24. In the case described the pump now pumps a smaller quantity of liquid than before at the same pressure.

It should be noted that the double diaphragm occupies its maximum position and minimum position respectively, when the capacity of the pump just has been reached or exceeded and when little or no liquid at all flows out of the pump, respectively.

The special situation will now be explained, when the pump cannot deliver the quantity of liquid, which would be required according to the setting of the regulator, by way of example when the input quantity of liquid is limited, reference being made to FIG. 6. The function of the diaphragm 34 is important in this case, as, in case such a diaphragm should not have been arranged, the regulator would have reacted, as if the pressure sensed had not corresponded to the adjusted pressure. This would have brought in its train that the diaphragm 12 would have occupied its maximum position setting the power source to deliver its maximum effect with cavitation and the risk of an interruption of the flow of liquid in the pump as a result. The diaphragm 34 is therefore adjusted to the effect that at an absolute pressure of approximately 0.3 kg and less it will impede the opening up of the passage 24, so that the pressure in the first chamber 16 is increased and brings about an increase of the gasoline supply. The gas supply is instead now reduced as a consequence of too small a quantity of liquid flowing past the valve body 21. Thanks to the diaphragm 34 an equilibrium is now reached with an input pressure of the pump of approximately 0.3 kg completely independent of the output pressure of the pump. Thus, this brings in its train that the pump can pump the maximum quantity of liquid permitted by the prevailing conditions The automatic displacement of the liquid supply control to its minimum position, when the supply of liquid to the pump is completely interrupted, is an additional function of the regulator. This does not take place by a pressure of liquid between the diaphragm elements 12A and 12B respectively of the double diaphragm 12, as was the case in the previously described situations, as in this case the atmospheric pressure prevails in the space 27 between them. The spring 7 on the arm 4 will press the diaphragm 12 in upwards direction, when an interruption of the liquid flow takes place, so that the liquid in the chambers 16 and 18 is drained out through the valve arrangement 21, 22 and the back way past the ball valve.

The regulator schematically illustrated in FIG. 7 essentially corresponds to the regulator described and illustrated in the previous drawings with the exception that the double diaphragm has been replaced by a valve arrangement $12^2$ comprising a number of elements, more particularly one diaphragm $12A^2$ and a piston $12B^2$. Both these elements are connected with each other in a similar way as the diaphragm in the previously described regulator. A chamber $27^2$ emptying into the atmosphere is formed between the diaphragm $12A^2$ and the piston $12B^2$. A chamber $16^2$, which borders upon the diaphragm $12A^2$, corresponds to the above-mentioned first chamber 16. A further chamber $15^2$, which borders upon the piston $12B^2$, and which is sealed from the atmosphere, is via a duct $26^2$ connected with a secondary valve arrangement $21^2$, $22^2$ similar to the one previously described.

The active pressure surface areas of the diaphragm element $12A^2$ and the piston element $12B^2$ respectively differ from each other in the same manner as in the described double diaphragm 12, by way of a suggestion likewise with the relation 4:1.

The function of the additionally described regulator is substantially identical to the function of the previously described regulator in spite of the fact that the space $27^2$ and $15^2$ respectively, which is defined by the valve elements $12A^2$ and $12B^2$, and borders upon a valve element $12B^2$ respectively, empties to the atmosphere and is connected with the first chamber $16^2$ respectively, i.e. quite contrary to what is the case in the described double diaphragm 12.

The invention is not limited to the example of embodiment illustrated in the drawings and described above, but can be varied within the scope of the following claims. It is quite possible to include a regulator in the scope of the invention, which by way of example only has one valve element, a spring possibly being provided which in case of a possible pressureless situation can move a piston connected with the liquid supply control, to its minimum position.

I claim:

1. A regulator for regulating the output pressure of a pump which has a suction side and a pressure side and is operatively connected to a motor for driving the pump, said regulator comprising: a housing, means movably arranged in said housing and operatively connected to said motor for controlling said motor which is driving said pump in accordance with the amount of movement of said movable means in said housing, a passage in said housing located between a duct for connection to the pressure side of the pump and discharge opening to atmosphere, first and second valve means movably arranged in said passage for co-operation with each other and for sensing the output pressure from the pump, one of said first and second valve means being arranged in said passage to control the communication of said passage with the surrounding air so as to always allow at least a small quantity of fluid to flow from said duct via said discharge opening, a second passage extending from said duct to said movable means, whereby increased or decreased output from said pump brings about a displacement of said movable means to a maximum or minimum position in said housing, said movable means comprising two elements connected to each other, at least one chamber between said elements, at least one element being adapted to communicate with atmosphere, at least one of said elements being in pressure communication with a first chamber communicating with said at least one chamber, a middle chamber in said housing between said first chamber and said first and second valve means, a diaphragm separating said middle chamber, means for actuating said diaphragm, said actuating means including a shaft connnected to said diaphragm, and arm for actuating said shaft, and means for controlling the position of said arm.

2. A regulator according to claim 1, wherein said at least one chamber is defined in part by the other element.

3. A regulator according to claim 1 or 2, wherein said elements are diaphragms.

4. A regulator according to claim 1 or 2, wherein said first chamber communicates with said at least one chamber via said passages.

5. A regulator according to claim 1, wherein said arm is a swinging arm having a first end connected to said first and second valve means, a second end connected to a bar and an area intermediate said ends engaging said shaft, a second chamber in said housing, a diaphragm in said second chamber and connected to said bar.

6. A regulator according to claim 5, wherein said second chamber comprises means for communicating with the suction side of the pump.

7. A regulator according to claim 1, wherein one of said elements has a surface area subject to pressure considerably larger than the surface area of the other element

8. A regulator according to claim 7, wherein the relationship between the surface area of said one element and said other element is 4 to 1.

9. A regulator according to claim 5, comprising a spring element having one end connected to said swinging arm and another end adjustable by said controlling means to thereby adjust the equilibrium of said two elements.

10. A regulator according to claim 1, wherein said first and second valve means includes a ball valve body, means for biasing said ball valve body to close a portion of said passage and a valve element co-operating with a valve seat for dislodging said ball valve body from the position closing said portion of said passage.

* * * * *